US006843644B2

(12) United States Patent
Rew et al.

(10) Patent No.: US 6,843,644 B2
(45) Date of Patent: Jan. 18, 2005

(54) MOUNTING STRUCTURE OF BLOWER FOR VACUUM CLEANER

(75) Inventors: Ho Seon Rew, Seoul-si (KR); Hyeun Sik Nam, Seoul-si (KR); Yong Woo Lee, Koyang-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/347,914

(22) Filed: Jan. 22, 2003

(65) Prior Publication Data

US 2004/0086395 A1 May 6, 2004

(30) Foreign Application Priority Data

Nov. 4, 2002 (KR) ..... 10-2002-0067841

(51) Int. Cl.[7] ..... F04B 17/00; F04B 39/00

(52) U.S. Cl. ..... 417/423.2; 417/312; 417/363; 417/423.14

(58) Field of Search ..... 417/312, 360, 417/363, 423.2, 423.15, 423.14

(56) References Cited

U.S. PATENT DOCUMENTS 2,155,669 A * 4/1939 Einar ..... 55/373
2,780,826 A * 2/1957 Coons et al. ..... 15/327.3
3,835,626 A * 9/1974 Miyake et al. ..... 55/319
4,356,591 A * 11/1982 Lude ..... 15/326
5,567,127 A * 10/1996 Wentz ..... 417/312
5,640,740 A * 6/1997 Martin et al. ..... 15/327.1
6,677,564 B1 * 1/2004 Sohn et al. ..... 219/757

FOREIGN PATENT DOCUMENTS

JP 10-52385 * 2/1998 ..... A47L/9/00
JP 10-192197 * 7/1998 ..... A47L/9/00

* cited by examiner

*Primary Examiner*—Justine R. Yu
*Assistant Examiner*—Timothy P. Solak
(74) *Attorney, Agent, or Firm*—Greenblum & Bernstein, P.L.C.

(57) ABSTRACT

Disclosed is a mounting structure of a blower for a vacuum cleaner comprising a mounting cover for fixing the blower to a body base so that the blower is structurally separated from a body cover. The mounting cover is put on the upper surface of the blower disposed on supporting ribs, and connected to the body base, and then the body cover is put on the body base. The blower is fixedly interposed between the supporting ribs and the mounting cover and separated from the body cover, thereby preventing oscillation generated by the blower from being transmitting to the body cover and then preventing the oscillation of the body cover and the consequently occurring noise of the body cover.

12 Claims, 7 Drawing Sheets

MOUNTING STRUCTURE OF BLOWER FOR VACUUM CLEANER

BACKGROUND OF THE INVENTION

1. Field of the Invention

The present invention relates to a mounting structure of a blower for a vacuum cleaner, and more particularly to a mounting structure of a blower for a vacuum cleaner, comprising a mounting cover for fixing the blower to a body base so that the blower is structurally separated from a body cover.

2. Description of the Related Art

Generally, a vacuum cleaner generates a vacuum within its body using a blower, thereby sucking rubbish such as dust together with external air and collecting the sucked rubbish. Recently, vacuum cleaners have been developed so as to improve blast performance of the blower and reduce undesired noise generated by the blower.

FIGS. 1 and 2 are cross-sectional and plan views of a mounting structure of a blower for a conventional vacuum cleaner, respectively.

The conventional vacuum cleaner comprises a body, a suction device (not shown) connected to an intake port 11 of the body, a dust collection bag (not shown) installed within the body, and a blower 30 installed within the body. A vacuum is generated within the body. The suction device sucks rubbish such as dust on the floor together with external air using the vacuum. The dust collection bag serves to collect the sucked rubbish and pass the sucked external air through. The blower 30 generates a vacuum within the body so that the rubbish together with external air is sucked into the body via the suction device.

Herein, the body includes a body base 10 being opened to the outside at its upper surface, and a body cover 20 being put on the opened upper surface of the body base 10. The interior of the body base 10 is divided into a dust chamber 12 provided with the dust collection bag installed therein, an air supply chamber 13 provided with the blower 30 installed therein, and a cord room 14 incorporating a cord reel (not shown) for winding an electric wire supplying power to the blower 30 thereon. A dust collection hole 21 is formed at an area on the body cover 20, corresponding to the dust chamber 12 of the body base 10, thereby allowing the dust collection bag to be replaced with a new one. A dust chamber cover 22 is detachably disposed on the dust collection hole 21 of the body cover 20 so as to open and close the dust collection hole 21.

A filter 18 for purifying air flowing into the blower 30 is installed between the dust chamber 12 and the air supply chamber 13.

The blower 30 is installed behind the filter 18, and includes an impeller 32 for generating a vacuum within the body, and a motor 34 connected to the impeller 32 by a rotary axis 33, for rotating the impeller 32. When power is applied to the motor 34, the motor 34 operates at a high speed of more than approximately 30,000 rpm.

In order to protect the blower 30 from external impacts, the front external surface of the blower 30 is surrounded by a mounting packing 36, and the rear external surface of the blower 30 is surrounded by a sealing packing 37. The central external surface of the blower 30 is surrounded by a sound cover 38 so as to shield noise generated by the operation of the motor 34.

As shown in FIGS. 1 and 2, in the mounting structure of the blower for the conventional vacuum cleaner, first and second supporting ribs 15 and 16 are protruded from the bottom surface of the body base 10 so as to respectively support the front portion of the blower 30 surrounded by the mounting packing 36 and the rear portion of the blower 30 surrounded by the sealing packing 37. Further, first and second pressing ribs 25 and 26 are protruded from the inner wall of the body cover 20 so as to respectively press the front portion of the blower 30 surrounded by the mounting packing 36 and the rear portion of the blower 30 surrounded by the sealing packing 37. Thereby, the blower 30 is fixedly interposed between the body base 10 and the body cover 20.

The mounting operation of the blower 30 within the body base 10 and the body cover 20 of the vacuum cleaner is described as follows. First, the blower 30 is disposed on the first and second supporting ribs 15 and 16, and the body cover 20 is put on the body base 10. Then, the front portion of the blower 30 surrounded by the mounting packing 36 is pressed by the first supporting rib 15 and the first pressing rib 25, and the rear portion of the blower 30 surrounded by the sealing packing 37 is pressed by the second supporting rib 16 and the second pressing rib 26. Thereby, the blower 30 is fixedly interposed between the body base 10 and the body cover 20.

In the above-described mounting structure of the blower for the conventional vacuum cleaner, since the body cover 20 is structurally connected to the blower 30 by means of the first and second pressing ribs 25 and 26, oscillation or noise generated by the operation of the blower 30 resonates at the body cover 20, thereby generating more resonant noise and causing annoyance to users.

Particularly, FIG. 3 is a graph illustrating the oscillation frequency of the body of the vacuum cleaner generated by the operation of the blower, measured by an accelerometer at the center of the upper surface of the body. When utility power of 60 Hz is applied to the motor 34, the motor 34 rotates at a high speed of more than 30,000 rpm. At this time, a peak (a) is found at about a self resonance frequency (SRF) of the motor 34, and a peak (b) is found at a frequency of about 120, 240, or 360 Hz, corresponding to a harmonic frequency of the external power. Further, a peak(c) is found at a frequency of about 4,500 Hz. Such peaks (a, b, and c) found at specific frequency bands are audible to humans, thereby causing stress to users.

Herein, the SPF is defined by the below equation, and the impeller 32 has nine vanes. Therefore, the peak(c) is found at 4,500 Hz, obtained by multiplying the value of the SRF by the number of the vanes of the impeller 32.

$$SRF = \frac{rpm}{frequencyofexternalpower}\ \text{Hz}$$

SUMMARY OF THE INVENTION

Therefore, the present invention has been made in view of the above problems, and it is an object of the present invention to provide a mounting structure of a blower for a vacuum cleaner so as to prevent resonant noise from being generated at a body cover by the resonance of oscillation or noise generated by the blower.

In accordance with the present invention, the above and other objects can be accomplished by the provision of a mounting structure of a blower for a vacuum cleaner, comprising: a body including a body base opened to the outside at an upper surface, and a body cover covering the upper surface of the body base; supporting ribs protruded from the bottom surface of the body base; a blower being mounted on the supporting ribs and serving to generate a vacuum within the body; and a mounting cover being connected to the body base so as to cover the upper surface of the blower and fixing the blower between the supporting ribs.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
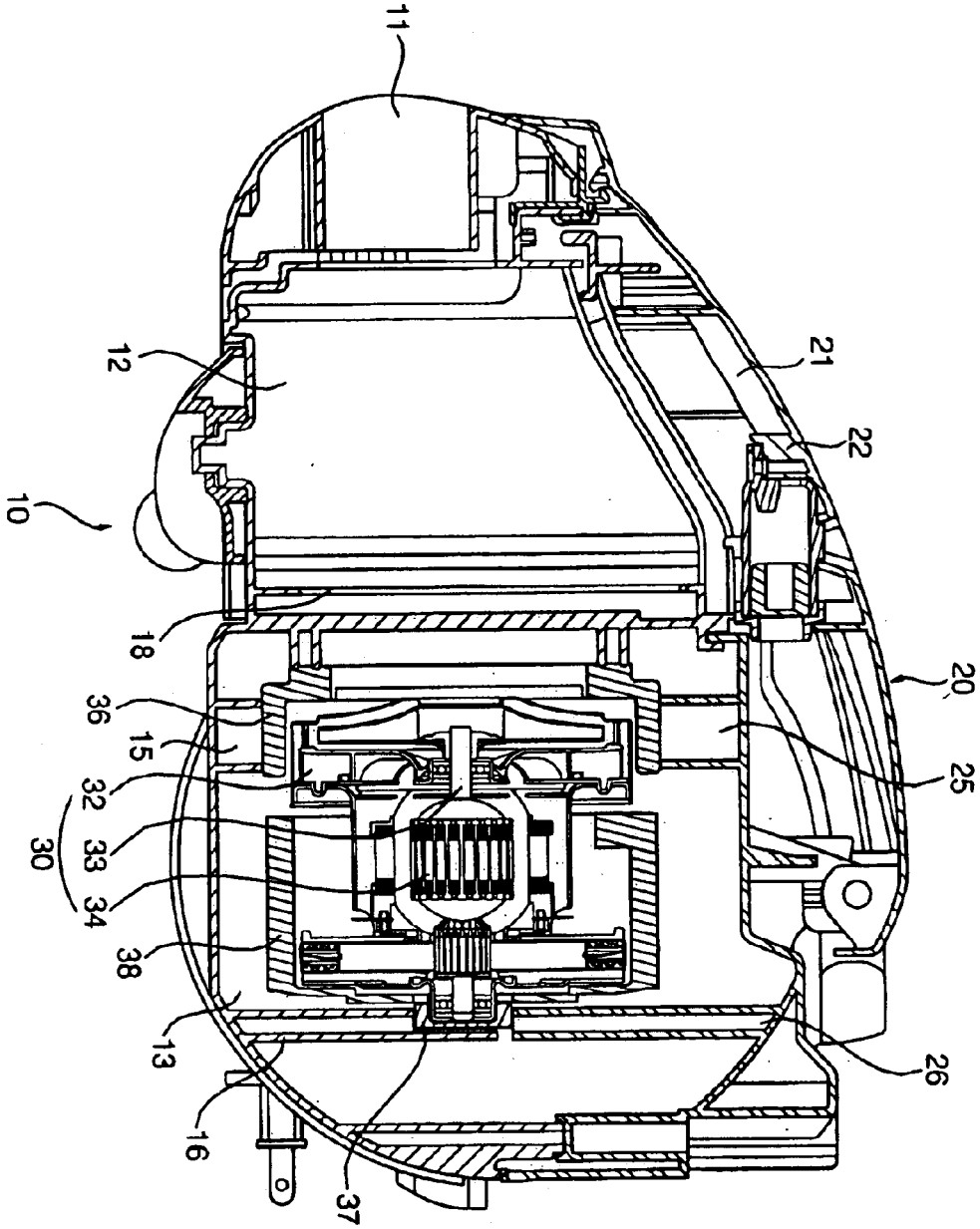
Fig. 1(Prior Art)
FIG. 1 is a cross-sectional view of a mounting structure of a blower for a conventional vacuum cleaner.
Figure 2:
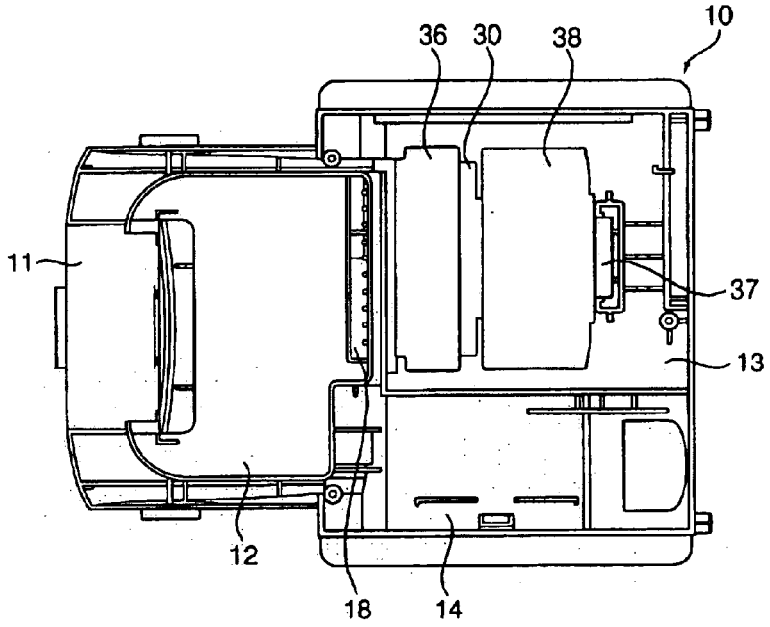
Fig. 2(Prior Art)
FIG. 2 is a plan view of the mounting structure of the blower for the conventional vacuum cleaner.

Now, preferred embodiments of the present invention will be described in detail with reference to the annexed drawings.

A mounting structure of a blower for a vacuum cleaner of the present invention comprises a body forming an exterior of the vacuum cleaner, supporting ribs 72 and 74, a blower 80, and a mounting cover 90. The body includes a body base 50 being opened to the outside at its upper surface, and a body cover 60 being put on the opened upper surface of the body base 50. The supporting ribs 72 and 74 are perpendicularly protruded from the bottom surface of the body base 50. The blower 80 is mounted on the supporting ribs 72 and 74, and serves to generate a vacuum within the body including the body base 50 and the body cover 60. The mounting cover 90 is connected to the body base 50 so as to cover the blower 80, thereby fixing the blower 80 between the supporting ribs 72 and 74.

The body base 50 includes a dust chamber 51 provided with a dust collection bag (not shown) for collecting rubbish, an air supply chamber 52 provided with the blower 80, and a partition board 53 for separating the dust chamber 51 and the air supply chamber 52. A filter 54 is installed on one side of the partition board 53 within the dust chamber 51 so as to purify air flowing into the blower 80. A stay rib 55 is perpendicularly protruded from the other side of the partition board 53 so as to contact the front portion of the blower 80 mounted on the supporting ribs 72 and 74, thereby limiting the forward movement of the blower 80.

The supporting ribs 72 and 74 consist of a first supporting rib 72 perpendicularly protruded from the bottom surface of the air supply chamber 52 of the body base 50 so as to support the front portion of the blower 80, and a second supporting rib 74 perpendicularly protruded from the bottom surface of the air supply chamber 52 of the body base 50 so as to support the rear portion of the blower 80.

Herein, since the front and rear portions of the blower 80 have different diameters, the first and second supporting ribs 72 and 74 have designated heights h1 and h2 so that a central axis of the blower 80 is parallel with the bottom surface of the body base 50 when the blower 80 is mounted on the supporting ribs 72 and 74.

A stopper rib 56 is installed on the upper end of the second supporting rib 74 so as to surround the rear portion of the blower 80, thereby preventing the blower 80 from moving back and forth between the stay rib 55 and the stopper rib 56 and from moving right and left.

The blower 80 includes an impeller 82 for generating a blast force, and a motor 84 connected to the impeller 82 by a rotary axis 83. External surfaces of the front and rear portions of the blower 80 are respectively surrounded by a mounting packing 76 and a sealing packing 77, made of rubber, so as to protect the blower 80 from external impacts. An external surface of the central portion of the blower 80 is surrounded by a sound cover 78 molded out of a sound absorbing material so as to shield noise due to airflow generated by the operation of the blower 80. The blower 80 surrounded by the mounting packing 76, the sealing packing 77, and the sound cover 78 is mounted on the supporting ribs 72 and 74, and the upper surface of the blower 80 is surrounded by the mounting cover 90.

Herein, a blower housing 86 forming an exterior of the blower 80 has a rear central portion 86A having a cylindrical shape and protruding from the rear portion of the blower housing 86 so that a bearing 87 for rotatably supporting the rotary axis 83 is installed between the blower housing 86 and the rear portion of the rotary axis 83. An external surface of the back central portion 86A of the blower housing 86 is surrounded by the sealing packing 77, and the sealing packing 77 has a rectangular shape so as to prevent the blower 80 from rotating.

The mounting cover 90 includes a cover portion 92, pressing ribs 94, and flanges 95 and 97. The cover portion 92 has a designated curvature along the external surface of the blower 80 so as to surround the upper portion of the external surface of the blower 80. The pressing ribs 94 are perpendicularly protruded from the inner wall of the cover portion 92 toward the blower 80, thereby pressing the blower 80 mounted on the supporting ribs 72 and 74. The flanges 95 and 97 are formed integrally with the cover portion 92, and connected to the body base 50.

Herein, the cover portion 92 has an arc shape with a designated diameter so as to be separated from the mounting packing 76 and the sound cover 78 in a radial direction in assembling the blower 80. A front surface of the blower 80 is opened so as to contact the stay rib 55, and a rear surface 91 of the blower 80 covers the upper part of the rear portion of the blower 80.

The pressing ribs 94 are perpendicularly protruded from the inner wall of the cover portion 92 so as to press the external surface of the mounting packing 76 in assembling the blower 80, and each of the pressing ribs 94 has an arc shape formed along the inner wall of the cover portion 92.

The flanges 95 and 97 consist of a first flange 95 extended from the lower part of the front portion of the cover portion 92, and a second flange 97 protruded from the rear surface 91 of the cover portion 92. The first and second flanges 95 and 97 are connected to the body base 50 by means of bolts.

That is, a first boss 57 provided with a first thread groove 57A is protruded from the bottom surface of the air supply chamber 52 of the body base 50, and separated from the right side of the front portion of the blower 80 by a designated distance. The first flange 95 has a first screw hole 95A being protruded from the cover portion 92 so as to contact the upper surface of the first boss 57 so as to correspond to the first thread groove 57A. Thereby, when a first bolt 98 is simultaneously screwed into the first screw hole 95A and the first thread groove 57A, the first flange 95 is fixed to the body base 50.

Further, a second boss 58 provided with a second thread groove 58A is protruded from the bottom surface of the air supply chamber 52 of the body base 50 behind the second supporting rib 74. The second flange 97 has a second screw hole 97A being protruded from the cover portion 92 so as to contact the upper surface of the second boss 58 so as to correspond to the second thread groove 58A. Thereby, when a second bolt 99 is simultaneously screwed into the second screw hole 97A and the second thread groove 58A, the first flange 97 is fixed to the body base 50.

Particularly, since a third screw hole 61 corresponding to the second thread groove 58A is formed through the body cover 60 so as to connect the body cover 60 to the body base 50 by means of a bolt, when the second flange 97 is interposed between the second boss 58 and the body cover 60, and the second bolt 99 is successively screwed into the third screw hole 61, the second screw hole 97A, and the second thread groove 58A, the second flange 97 together with the body cover 60 is fixed to the body base 50.

Hereinafter, a mounting operation of the above-described blower of the present invention will be described.

First, the blower 80 is surrounded by the mounting packing 76, the sealing packing 77, and the sound cover 78. The blower 80 is disposed between the stay rib 55 and the stopper rib 56 on the body base 50. Then, the blower 80 is mounted on the first and second supporting ribs 72 and 74.

In such condition, the mounting cover 90 is put on the upper surface of the blower 80 so that the first screw hole 95A of the first flange 95 is correspondingly aligned on the first thread groove 57A of the first boss 57, and the second screw hole 97A of the second flange 97 is correspondingly aligned on the second thread groove 58A of the second boss 58. Then, the first bolt 98 is screwed into the first screw hole 95A of the first flange 95 and the first thread groove 57A of the first boss 57, thereby fixing one side of the mounting cover 90 to the body base 50.

Next, The body cover 60 is put on the upper portion of the body base 50 so that the third screw hole 61 of the body cover 60 is correspondingly aligned on the second screw hole 97A of the second flange 97 and the second thread groove 58A of the second boss 58. Then, the second bolt 99 is successively screwed into the third screw hole 61 of the body cover 60, the second screw hole 97A of the second flange 97, and the second thread groove 58A of the second boss 58. Thereby, the body base 50, the body cover 60, and the mounting cover 90 are simultaneously connected to each other, and the mounting operation of the blower 80 is completed.

The blower 80 is pressingly fixed between the supporting ribs 72 and 74, and the mounting cover 90. The body cover 60 are not directly connected to the blower 80. Therefore, the body cover 60 is prevented from resonating due to the oscillation or noise generated by the blower 80.

Figure 3:
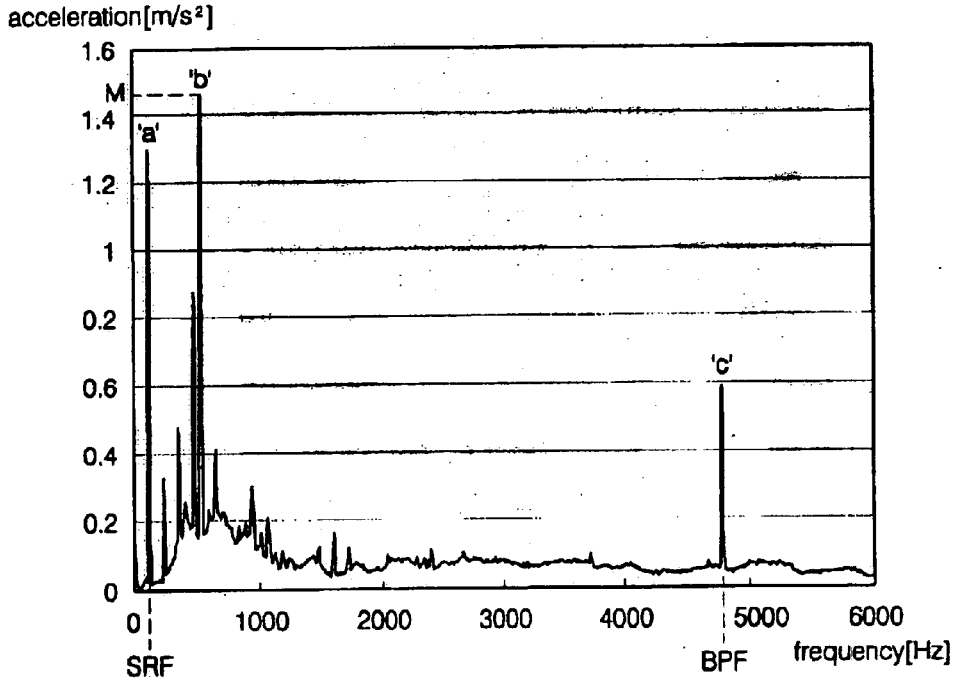
Fig. 3(Prior Art)
FIG. 3 is a graph showing the relationship between the acceleration and the oscillation frequency of the conventional vacuum cleaner.
Figure 7:
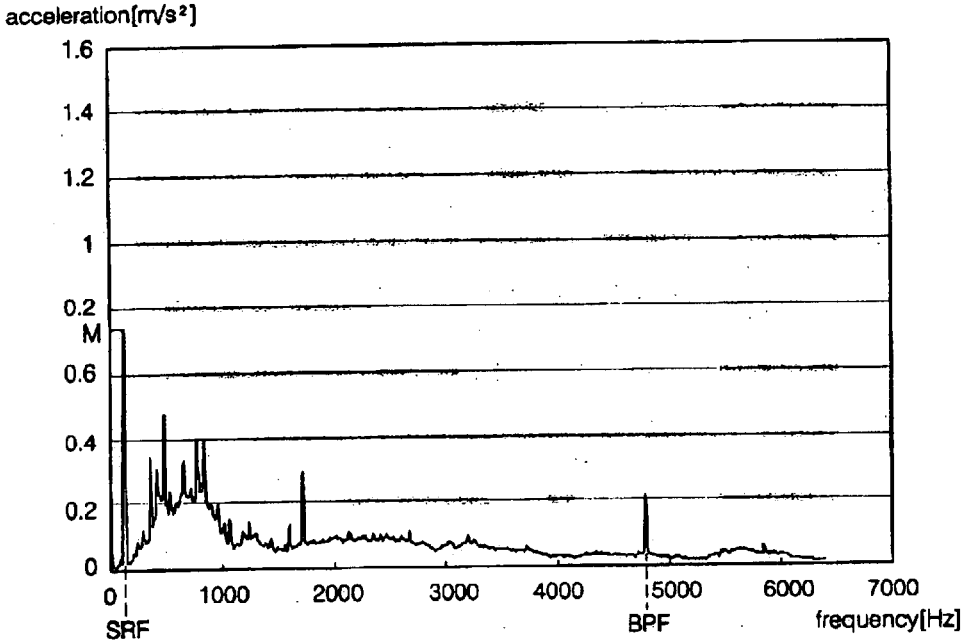
FIG. 7 is a graph showing the relationship between the acceleration and the oscillation frequency of the vacuum cleaner of the present invention.

FIG. 7 is a graph illustrating the oscillation frequency of the body of the vacuum cleaner generated by the operation of the blower, measured by an accelerometer at the center of the upper surface of the body. Compared to the graph of FIG. 3, the graph of FIG. 7 will be described hereinafter.

When external power of 60 Hz is applied to the blower, the blower is operated at a high speed of more than 30,000 rpm. Herein, the maximum value (M) of the conventional oscillation frequency is 1.44 $m/s^2$, but the maximum value (M) of the oscillation frequency (M) of the present invention is 0.74 $m/s^2$. Further, the conventional peak (a) at the SRF is 1.4 $m/s^2$, but the peak (a) of the present invention at the SRF is 0.74 $m/s^2$. In case of the peak(c), which is found at 4,500 Hz, obtained by multiplying the value of the SRF by the number of the vanes of the impeller, the conventional peak (c) is 0.6 $m/s^2$, but the peak (c) of the present invention is 0.2 $m/s^2$.

Therefore, the oscillation and noise in the body of the vacuum cleaner are increasingly reduced by preventing the oscillation generated by the blower 80 from being transmitted to the body cover 60.

Figure 8:
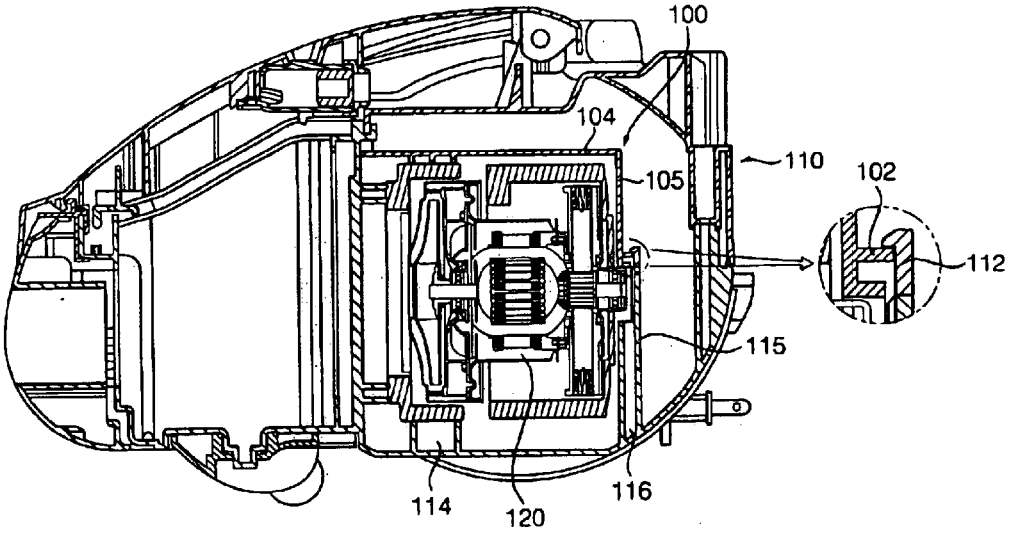
FIG. 8 is a cross-sectional view of a mounting structure of a blower for a vacuum cleaner in accordance with another embodiment of the present invention.
Figure 9:
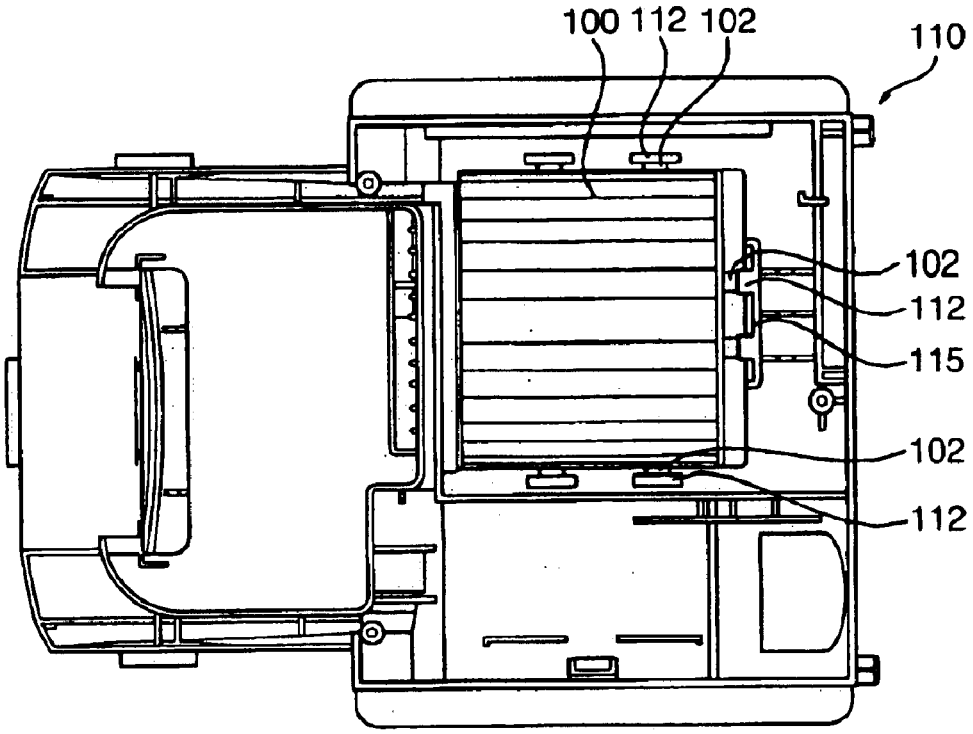
FIG. 9 is a plan view of the mounting structure of the blower for the vacuum cleaner in accordance with another embodiment of the present invention.

FIGS. 8 and 9 are cross-sectional and plan views of a mounting structure of a blower for a vacuum cleaner in accordance with another embodiment of the present invention.

The mounting structure of the blower for the vacuum cleaner in accordance with another embodiment of the present invention comprises a plurality of locking protrusions 102 and a plurality of hooks 112. The locking protrusions 102 are protruded from the external surface of a body cover 100 so as to be parallel with the bottom surface of a mounting base 110. The hooks 112 are protruded upward from the body base 110 so that the locking protrusions 102 are fixedly locked with the corresponding hooks 112 when the mounting cover 100 is put on the upper surface of a blower 120.

Herein, since a pair of the locking protrusions 102 are protruded from a rear surface 105 and left and right surfaces of a cover portion 104 of the mounting cover 100, there are provided a total of six locking protrusions 102. The hooks 112 total six so as to correspond to the locking protrusions 102. When the upper surface of the blower 120 is covered by the mounting cover 100, the locking protrusions 102 have designated heights from the bottom surface of the body base 110 so as to be disposed just under the hooks 112.

Particularly, the hooks 112 are made of plastic having a designated elasticity so as to be elastically crooked and then restored to the original state when the mounting cover 100 is attached to and detached from the upper surface of the blower 120. Among the hooks 112, the hooks 112 being coupled with the locking protrusions 102 protruded from the rear surface 105 of the cover portion 104 of the mounting cover 100 are protruded upward from the upper end of the stopper rib 115.

Therefore, when the mounting cover 100 is pressed toward the blower 120 mounted on supporting ribs 114 and 116, the upper surface of the blower 120 is covered by the mounting cover 100 so that the locking protrusions 102 of the mounting cover 100 are disposed just under the hooks 112. Herein, since the locking protrusions 102 of the mounting cover 100 are locked with the corresponding hooks 112, the blower 120 is firmly fixed to the body base 110.

Figure 4:
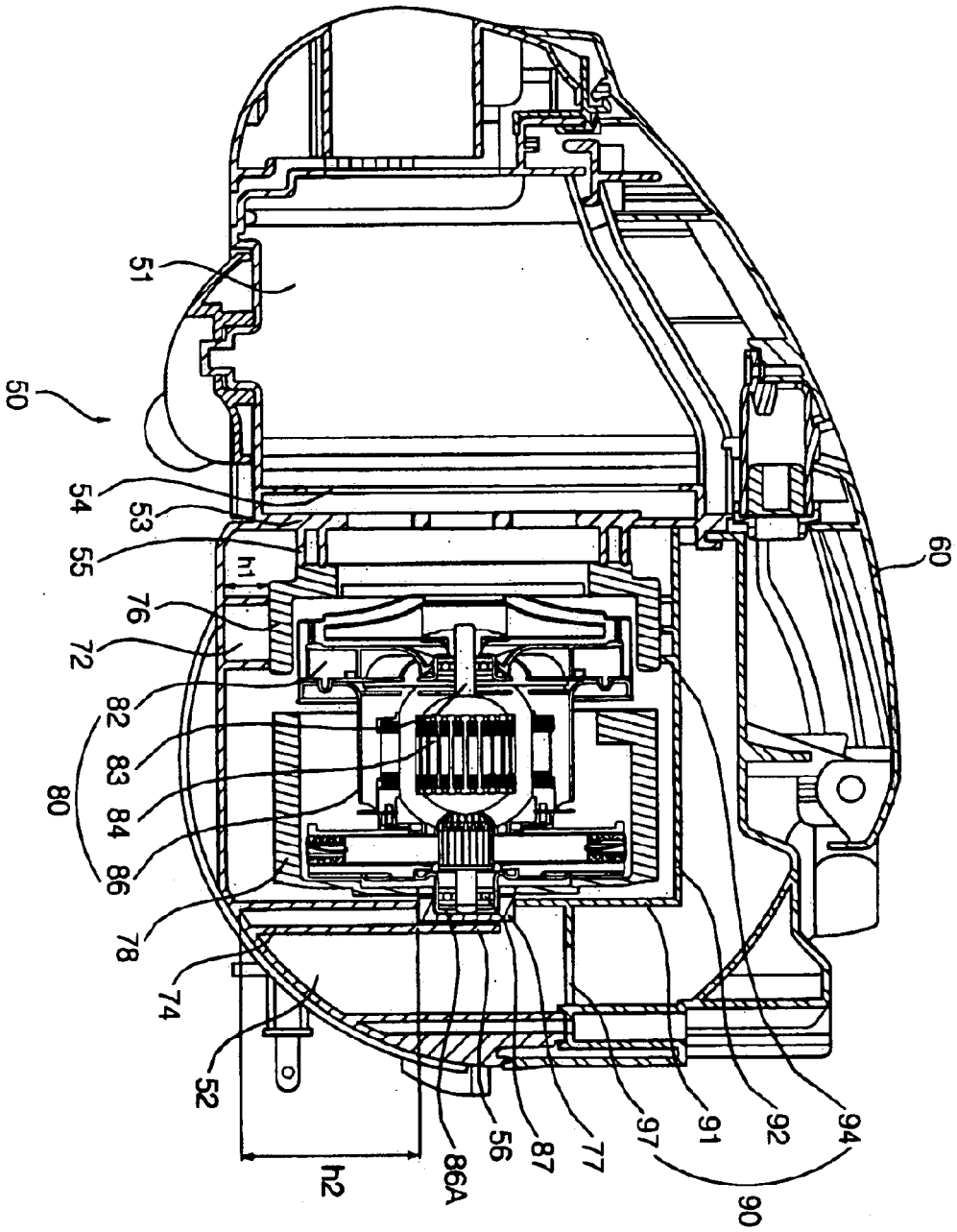
FIG. 4 is a cross-sectional view of a mounting structure of a blower for a vacuum cleaner in accordance with one embodiment of the present invention.
Figure 5A:
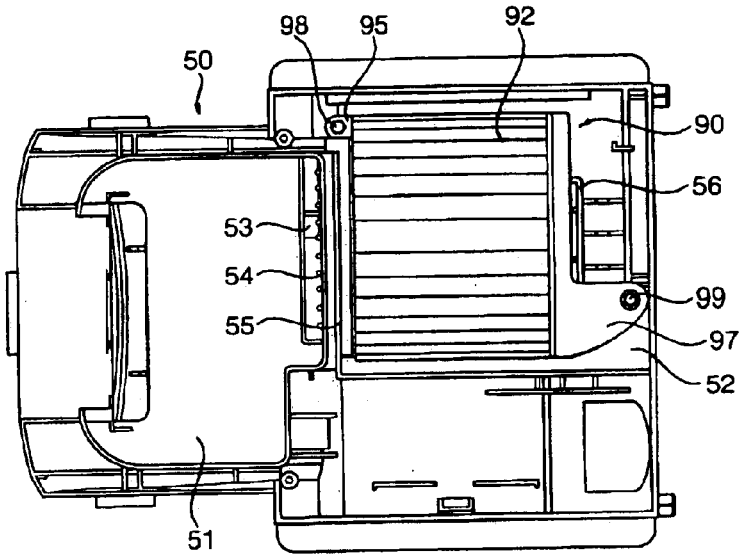
FIG. 5*a* is a plan view of the mounting structure of the blower for the vacuum cleaner in accordance with one embodiment of the present invention.
Figure 5B:
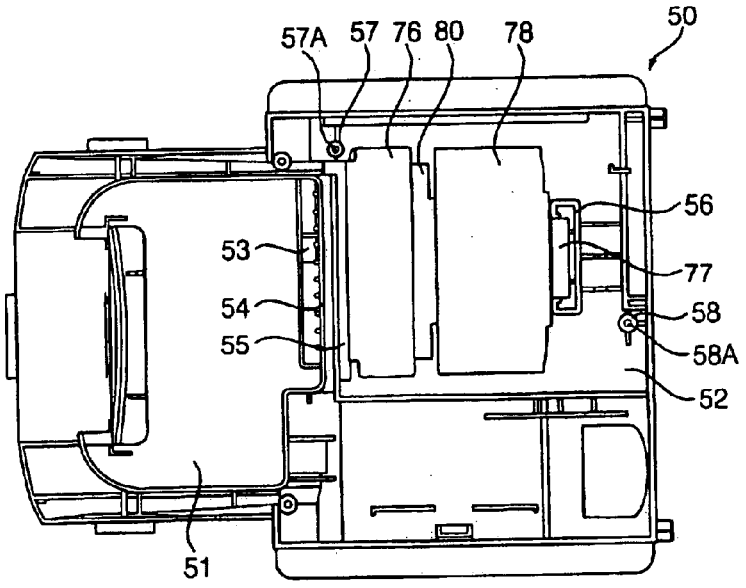
FIG. 5*b* is a plan view of the mounting structure of the blower for the vacuum cleaner in accordance with one embodiment of the present invention before a mounting cover is joined thereto.
Figure 6:
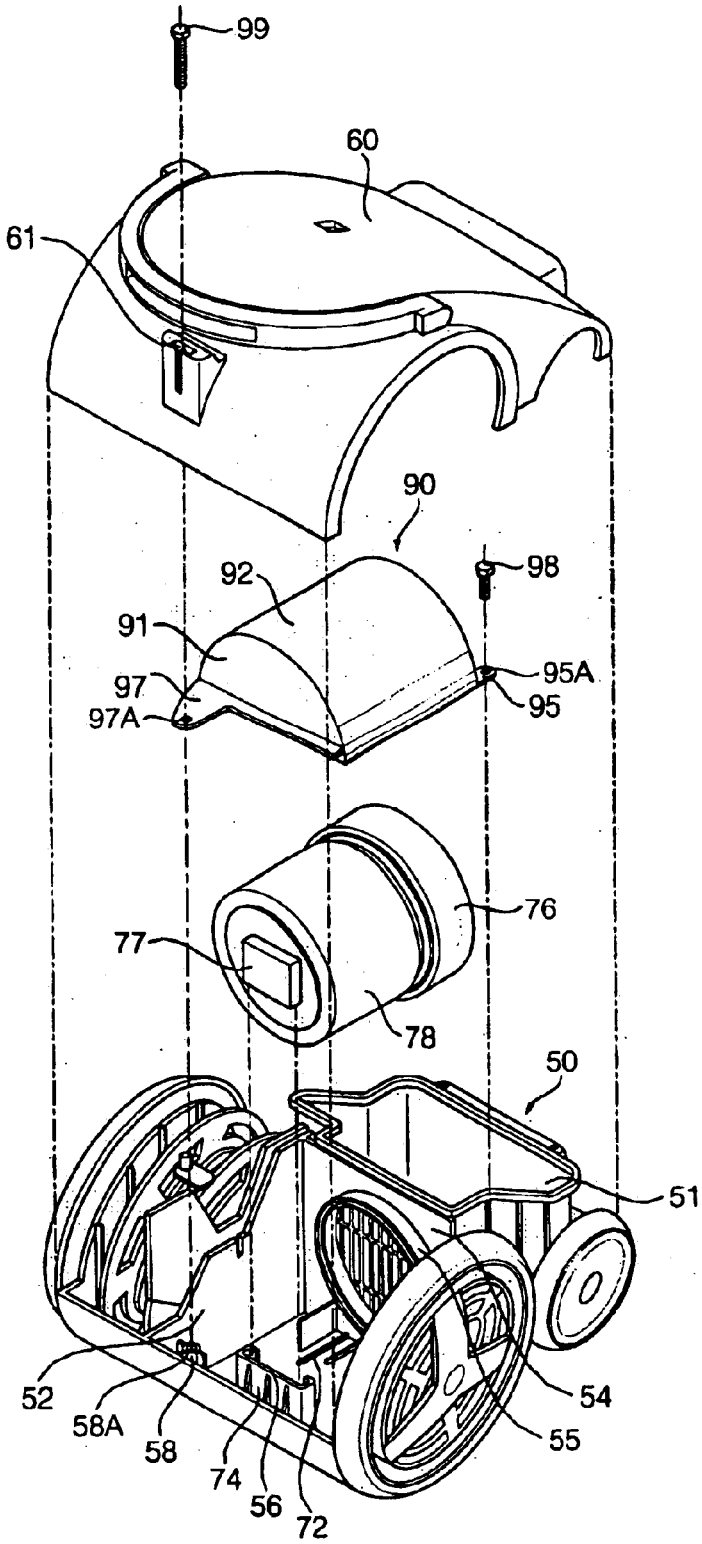
FIG. 6 is an exploded perspective view of the mounting structure of the blower for the vacuum cleaner in accordance with one embodiment of the present invention.

The vacuum cleaner of FIGS. 8 and 9 is the same as the vacuum cleaner of FIGS. 4 to 6 except for the connecting structure of the mounting cover and the body base. Therefore, the detailed description of the vacuum cleaner of FIGS. 8 and 9 will be omitted.

As apparent from the above description, the present invention provides a mounting structure of a blower for a vacuum cleaner, comprising a mounting cover for fixing the blower to a body base so that the blower is structurally separated from a body cover. The mounting cover is put on the upper surface of the blower disposed on supporting ribs, and connected to the body base, and then the body cover is put on the body base. The blower is fixedly interposed between the supporting ribs and the mounting cover and separated from the body cover, thereby preventing oscillation generated by the blower from being transmitting to the body cover and then preventing the oscillation of the body cover and the consequently occurring noise of the body cover.

Further, since the mounting cover together with the body cover is connected to the body base by means of bolts or hooks, the mounting structure of the blower for the vacuum cleaner of the present invention is easily produced and does not require many components, thereby reducing the assembly cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mounting structure of a blower for a vacuum cleaner, comprising:

a body including a body base opened to the outside at an upper surface, and a body cover covering the upper surface of the body base;

a plurality of supporting ribs protruded from a bottom surface of the body base;

a blower being mounted on the supporting ribs and serving to generate a vacuum within the body; and a mounting cover being connected to the body base so as to fix the blower between the supporting rib;

wherein the mounting cover comprises a cover portion that surrounds an upper portion of the blower, the cover portion being not in contact with the body cover.

2. The mounting structure of a blower for a vacuum cleaner as set forth in claim 1, wherein the supporting ribs comprise a first supporting rib that supports the front portion of the blower, and a second supporting rib that supports the rear portion of the blower.

3. The mounting structure of a blower for a vacuum cleaner as set forth in claim 2, wherein the first and second supporting ribs have predetermined heights so that the blower mounted on the supporting ribs is parallel with the bottom surface of the body base.

4. The mounting structure of a blower for a vacuum cleaner as set forth in claim 1, wherein the blower is surrounded by a mounting packing and a sealing packing respectively at its front and rear portions, and by a sound cover at its central portion so as to shield noise generated in the operation of the blower, and the mounting cover covers upper portions of the mounting packing, the sealing packing, and the sound cover.

5. The mounting structure of a blower for a vacuum cleaner as set forth in claim 4, wherein the mounting cover comprises:

a plurality of pressing ribs protruded from the inner wall of the cover portion toward the blower so as to press the blower between the supporting ribs; and a plurality of flanges formed integrally with the cover portion and connected to the body base.

6. The mounting structure of a blower for a vacuum cleaner as set forth in claim 5, wherein the pressing ribs are perpendicularly protruded from the inner wall toward the mounting packing.

7. The mounting structure of a blower for a vacuum cleaner as set forth in claim 5, wherein a screw hole is formed in the flange so as to correspond to a thread groove formed in a boss protruded from the bottom surface of the body base, and the flange is connected to the body base by a bolt being screwed into the screw hole of the flange and the thread groove of the body base.

8. The mounting structure of a blower for a vacuum cleaner as set forth in claim 7, wherein at least one screw hole is formed in the flange so as to be correspondingly aligned the thread groove of the body base and a screw hole of the body cover corresponding to the thread groove of the body base, thereby bolt-connecting the flange simultaneously to the body base and the body cover.

9. The mounting structure of a blower for a vacuum cleaner as set forth in claim 1, wherein a plurality of locking protrusions are formed on the mounting cover along its external surface, and a plurality hooks are protruded from the body base so as to correspond to the locking protrusions of the mounting cover locked thereto, thereby hook-connecting the mounting cover to the body base.

10. The mounting structure of a blower for a vacuum cleaner as set forth in claim 9, wherein at least one of the hooks is protruded upward from an upper end of the supporting rib integrally with the supporting rib.

11. The mounting structure of a blower for a vacuum cleaner as set forth in claim 9, wherein the hooks are made of plastic with a designated elasticity.

12. The mounting structure of a blower for a vacuum cleaner as set forth in claim 1, wherein the mounting cover is made of plastic.

* * * * *

UNITED STATES PATENT AND TRADEMARK OFFICE

CERTIFICATE OF CORRECTION

PATENT NO. : 6,843,644 B2
DATED : January 18, 2005
INVENTOR(S) : H. S. Rew et al.

It is certified that error appears in the above-identified patent and that said Letters Patent is hereby corrected as shown below:

Column 7,
Line 49, “rib;” should be -- ribs, --.

Signed and Sealed this

Thirtieth Day of August, 2005

JON W. DUDAS
*Director of the United States Patent and Trademark Office*